US005249996A

United States Patent [19]

Brown

[11] Patent Number: 5,249,996

[45] Date of Patent: Oct. 5, 1993

[54] OAR STOP SOUND DAMPENER

[76] Inventor: Dennis B. Brown, 343 W. 400 North, Logan, Utah 84321

[21] Appl. No.: 902,686

[22] Filed: Jun. 22, 1992

[51] Int. Cl.[5] ..... B63H 16/06

[52] U.S. Cl. ..... 440/104; 440/106; 440/101

[58] Field of Search ..... 440/102–110; 416/69, 70 R, 74; D12/215; 441/81, 131

[56] References Cited

U.S. PATENT DOCUMENTS

| | | | |
|---|---|---|---|
| 742,490 | 10/1903 | Proy | 440/107 |
| 1,389,988 | 9/1921 | Rose | 440/110 |
| 2,105,110 | 1/1938 | Drisoll et al. | 441/81 |
| 2,602,172 | 7/1952 | Messman | 440/110 |
| 2,987,736 | 6/1961 | Wolff | 440/107 |
| 3,095,586 | 7/1963 | Baier | 441/81 |

*Primary Examiner*—Edwin L. Swinehart
*Attorney, Agent, or Firm*—Thompson E. Fehr

[57] ABSTRACT

An oar stop sound dampener which minimizes the sound produced during the rowing of a boat. It is composed of a flexible, solid, closed-cell foam and is placed on the shaft of the oar adjacent to the oar stop on the side toward the paddle. The dampener is a disk having an aperture at its center to accommodate the shaft of the oar and having a segment adjacent to such aperture which segment can be removed from the disk to provide space for the elongated member some oar stops have extending along the shaft of the oar toward the paddle. By keeping the oar stop, which is usually metal, from contacting the oar lock, which is customarily also metal, through the location of the disk and its resistance to compression, and because of the flexible nature of the disk, no discernible sound is produced during rowing; and wear of the oar stop and oar lock is minimized. Since the diameter of the aperture is the same as, or slightly smaller than, the diameter of the shaft of the oar, the oar stop sound dampener is held in place by friction and can readily be removed for cleansing or replacement. Optionally, fabric or a plastic laminate may be adhesively placed on the flat surfaces of the disk (or the fabric can be sewn to such flat surfaces) to minimize wear on the disk as well as degradation of the disk caused by exposure to ultraviolet light.

22 Claims, 2 Drawing Sheets

OAR STOP SOUND DAMPENER

BACKGROUND OF THE INVENTION

1. Field of the Invention

This invention relates to a device that is placed on an oar stop to dampen the sound produced by the rubbing of the oar stop against the oar lock as the oar is operated to propel and steer a boat.

2. Description of the Related Art

The problem of friction between an oar lock, which acts as the fulcrum or bearing surface when an oar is used to propel a boat, and the oar stop, which prevents an oar from sliding through the oar lock into the water if the oar is released by the rower when the oar is in its operating position, has been explicitly considered in two inventions—U.S. Pat. No. 709,667 and U.S. Pat. No. 1,389,988.

In U.S. Pat. No. 709,667 of Henry Ditchburn the invention consisted of a flanged metallic collar which pivotally separated into two halves to facilitate placement on the oar. After being properly oriented on the oar, these two halves were screwed together. To minimize noise by preventing the metallic collar from contacting the oar lock, Mr. Ditchburn's oar stop also included two or more thicknesses of leather. The leather collar thus formed was essentially a disk whose thickness exceeded the length of the portion of the metallic collar that paralleled and was adjacent to the shaft of the oar. The center of the disk had an aperture of the size that would precisely accommodate the shaft of the oar, and the outer radial dimension of the leather collar caused it to extend approximately the same distance from the shaft as did the flange on the metallic collar that was perpendicular to the shaft. To permit the leather collar to be placed on the oar and metallic collar, the leather collar had on one side a physical division running from the aperture to the outer radial perimeter of the leather collar and extending the full thickness of the leather collar. Radial screws secured the leather collar and the metallic collar by passing through the leather collar and the portion of the metallic collar that paralleled and was adjacent to the shaft of the oar. The tips of these screws were imbedded in either the shaft of the oar or a leather shield surrounding such shaft.

Although the leather would reduce the noise as compared to that resulting from the contact of two metallic surfaces, anyone who has ever climbed into a saddle knows that leather is far from a silent material. Moreover, leather absorbs water and is unlikely to float—a factor that would be of greater significant were the leather collar more readily replaceable.

William A. Rose, in U.S. Pat. No. 1,389,988, claimed an oar stop whose primary structural element was a series of leather strips laid around the shaft of the oar on top of each other, the length of each strip being such that the ends of each strip would just abut each other. These strips were secured to the oar by tacking their ends and by a metallic clamp. The metallic clamp was a relatively short tubular structure. The portion of the clamp opposite the leather strips (when in use) had the same shape as did the cross section of the oar; the inside dimension of this portion of the clamp was the same as the outside dimension of the oar; and this portion of the clamp had screws securing it to the shaft of the oar. As the clamp approaches the leather strips, it retains the same shape; but its dimension expands so that it just covers, and thereby further secures, the leather strips.

According to the patent, the spacing is such that the oar lock can never contact the metallic clamp, only the leather strips. The clamp adds metallic support to the leather in acting as an oar stop; and the leather reduces friction (as compared to a metal-to-metal contact) consequently, decreasing wear and noise.

But, again, leather is not perfectly silent, absorbs water, and may not float. Furthermore, the leather strips are not readily replaceable.

The invention in U.S. Pat. No. 2,140,884 of Oscar J. Shape is a rubber sleeve for the shaft of an oar. The sleeve has a flange at one end to serve as an oar stop, is split longitudinally on one side to permit it to be placed on the shaft of the oar, and is nailed to the shaft. To have the necessary structural rigidity to serve as an oar stop, the rubber would have to be fairly hard and, thus, less than ideally silent when it contacts the metal of the oar lock—especially when rowing causes it to slide over the surface of the oar lock. In fact, the patent does not even discuss noise. The hard rubber is, additionally, unlikely to float and can be replaced only with significant effort and, of course, only by employing an entire new oar stop.

Similarly, the oar in U.S. Pat. No. 3,677,216 of Arthur J. Gentemann has a sleeve which fits around the shaft of an oar and which expands at one end to form a spherical oar stop. This would preferably be made of plastic and be cemented to the shaft. It would, therefore, have the same disadvantage as the immediately preceding patent, i.e., U.S. Pat. No. 2,140,884.

A protective sleeve around the shaft of an oar with a tabular projection from the sleeve serving as an oar stop is disclosed, but not claimed, in U.S. Pat. No. 2,252,252 of Louis H. Cross. There is no discussion of wear or noise, the materials used are not identified, and the method for attaching the sleeve to the shaft of the oar is not identified. Still, from the drawings it is apparent that the sleeve and oar stop could only be removed and replaced as a single unit.

Finally, an oar having a pentagonally shaped cross section where it fits into the oar lock is the subject of U.S. Pat. No. 231,016 of Michael F. Davis. Such portion of the shaft of the oar is conformally surrounded by a sleeve and flange that serves as an oar stop. The sleeve and flange come in two parts that are apparently held together with screws and both screwed and tacked into the shaft of the oar. There seems to be no discussion of noise, wear, or materials. The sleeve and oar stop would, however, not be readily replaceable.

SUMMARY OF THE INVENTION

An oar stop is placed on an oar to prevent the oar from sliding through an oar lock and into the water. The oar stop is, consequently, placed on the oar at the point where the desired length of oar will extend on each side of the oar lock and is, with respect to the oar lock, on the end of the oar having the handle (rather than the paddle).

No matter what materials are used to construct the oar lock and the oar stop, the rigidity which is essential to the performance of their intended functions causes considerable noise when they contact one another, as they necessarily must during the operation of the boat. (Generally, the oar lock and the oar stop are made of metal.) The bottom (or hull) of the boat acts as a diaphragm to amplify any noise generated by the oar lock and the oar stop. Obviously, this is a significant hindrance to conducting any activity with the boat where a quiet environment is either essential or desirable, such as fishing.

To minimize this unwanted noise, the present invention contemplates placing sound dampening material upon the oar adjacent to the oar stop on the side facing the end of the oar having the paddle so that such sound dampening material will be between the oar lock and the oar stop when the oar is placed in its operational position on the boat.

In the preferred embodiment the oar stop sound dampener is a short cylinder with thick walls, i.e., a disk. The center of the disk contains an aperture shaped to accommodate the shaft of the oar; the diameter of the aperture is the same as, or slightly smaller than, that for the shaft of the oar. The outer diameter of the disk is the same as that of the oar stop. Optionally, fabric or a plastic laminate may be placed on each of the two flat surfaces of the disk by means of an adhesive (or the fabric can be sewn to each of the flat surfaces of the disk); such fabric or plastic laminate is cut so as to cover precisely such flat surfaces and minimizes wear on the disk as well as degradation of the disk caused by exposure to ultraviolet light.

On oars with a removable paddle, the oar stop sound dampener is positioned by simply removing the paddle and sliding the dampener along the oar until it is adjacent to the oar stop. On other oars, the oar stop sound dampener is placed on the oar at the end opposite the paddle and slid along the oar to the oar stop, where the relative dimensions of the oar stop and the dampener as well as the flexibility of the dampener permit the dampener to be pushed over the oar stop and positioned adjacent to the oar stop on the side toward the paddle. Since the diameter of the hole in the center of the dampener is the same as, or slightly smaller than, the diameter of the cross section of the shaft of the oar, the dampener maintains its position adjacent to the oar stop through friction.

Because some oar stops have an elongated member extending from the basic oar stop a slight distance toward the end of the oar having the paddle (such elongated member being designed so as to fit into the upper end of the oar lock thereby maintaining a selected rotational orientation for the oar), a segment of the disk will be die cut, permitting such segment to be punched out in order to accommodate the elongated member.

The basic structure of the oar stop sound dampener will be constructed of a flexible, solid, closed-cell foam, such as neoprene foam. This closed-cell structure will strongly resist compression while still being sufficiently flexible to produce no discernible sound as it contacts the oar stop and the oar lock, and will, additionally, be impervious to water, thus, permitting it to float and to be washed after it has been removed from the oar stop.

Moreover, no screws or tacks, which weaken—to some extent—an oar, need be placed in the shaft of the oar to secure the sound dampener. And since even adhesive is not needed to secure the sound dampener to the oar, the sound dampener can readily be removed from and replaced on the shaft of the oar. Not only does this permit the sound dampener to be removed for cleansing, as discussed above, but it allows a new sound dampener to be placed on the oar without the necessity of also replacing the basic oar stop.

Finally, in addition its primary purpose of dampening sound, the oar stop sound dampener will extend the useful life of the oar lock by reducing friction between the oar stop and the oar lock.

BRIEF DESCRIPTION OF THE DRAWINGS

In order that the invention may be readily understood and put into practical effect, reference will now be made to the accompanying drawings which illustrate a preferred embodiment of the invention and wherein.

DESCRIPTION OF THE PREFERRED EMBODIMENT

Figure 2:
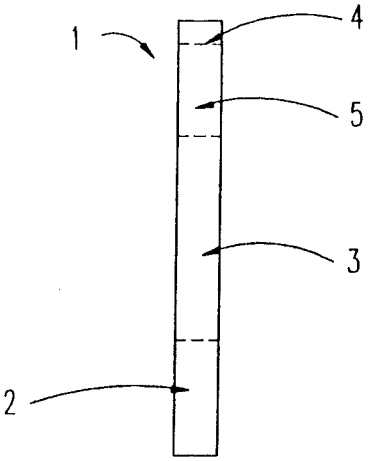
FIG. 2 is a lateral view of the oar stop sound dampener.
Figure 1:
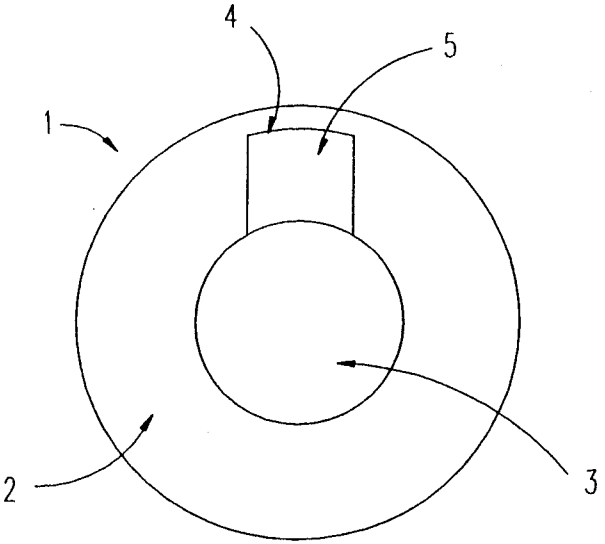
FIG. 1 is a view of the oar stop sound dampener from the front.
Figure 5:
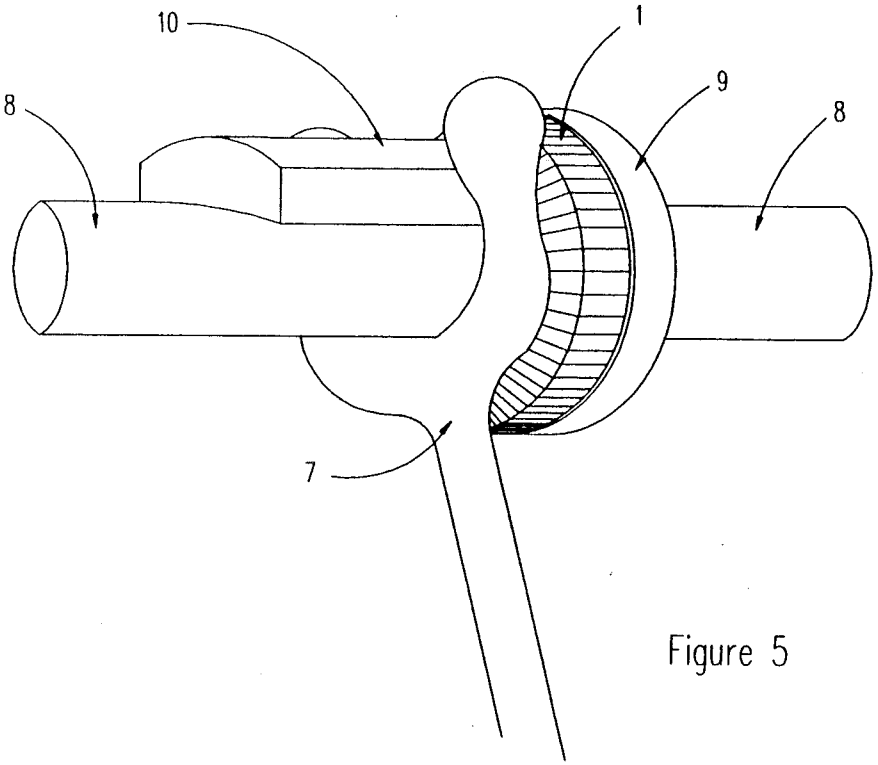
FIG. 5 illustrates the oar stop sound dampener positioned on an oar which has, itself, been placed in an oar lock and on which oar is located an oar stop with an elongated member to maintain a selected rotational orientation for the oar.
Figure 4:
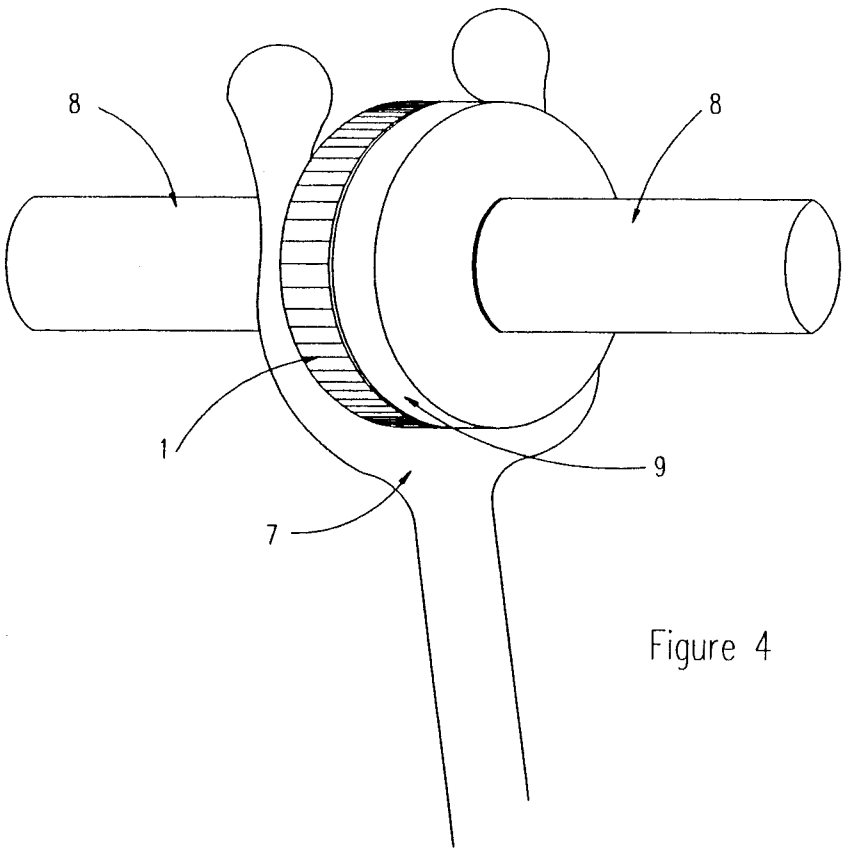
FIG. 4 shows the oar stop sound dampener installed on an oar which has, itself, been placed in an oar lock.

As can be seen from FIG. 1 and FIG. 2, the oar stop sound dampener (1) is a disk (2) having in its center an aperture (3) shaped to accommodate the shaft of the oar (8 in FIG. 4 and 5).

The diameter of the aperture (3) is the same as, or slightly smaller than, that of the shaft of the oar (8 in FIG. 4 and FIG. 5) on which the oar stop sound dampener (1) is to be placed. The outer diameter of the disk (2) is the same as that of the oar stop (9 in FIG. 4 and FIG. 5).

To accommodate an oar stop (9 in FIG. 5) having an elongated member (10 in FIG. 5) extending along the shaft of the oar (8 in FIG. 5) toward the end of the oar that has the paddle, which elongated member (10 in FIG. 5) is designed to fit into the upper end of the oar lock (7 in FIG. 5) so as to maintain a selected rotational orientation for the oar, a segment (5) of the disk (2) is die cut along an imaginary line (4), commencing and ending at the aperture (3) but not extending to the outer diameter of the disk (2). When it is desired to utilize the oar stop sound dampener (1) with an oar stop (9 in FIG. 5) having an elongated member (10 in FIG. 5), the segment (5) can simply be pressed until it separates from the disk (2).

Figure 3:
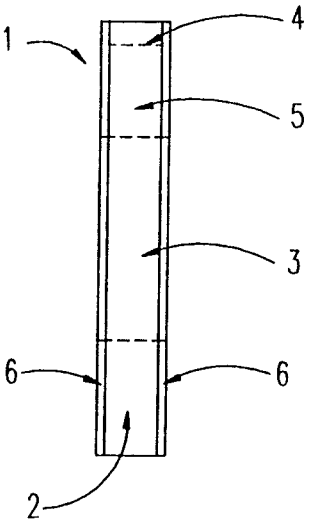
FIG. 3 is a lateral view of the oar stop sound dampener with the optional fabric or plastic laminate covering the flat surfaces of the disk.

Optionally, as demonstrated in FIG. 3, a thin cover layer (6) of fabric or plastic laminate may be attached with adhesive to the flat surface of the disk (2) (or the fabric may be sewn to each of the flat surfaces of the disk (2)). The cover layer (6) is cut to the same dimensions as the flat surfaces of the disk (2) and is also die cut along the same line (4 in FIG. 1 and FIG. 2) as is the disk. Wear on the disk (2) as well as degradation of the flexible, solid, closed-cell foam, such as neoprene foam, from which the disk (2) is made is minimized by the cover layer (6).

On oars with a removable paddle, the oar stop sound dampener (1) is positioned by simply removing the paddle and sliding the oar stop sound dampener along the shaft of the oar (8) until it is adjacent to the oar stop (9), as shown in FIG. 4 and FIG. 5. On other oars, the oar stop sound dampener (1) is placed on the oar at the end opposite the paddle and slid along the shaft of the oar (8) to the oar stop (9); the relative dimensions of the oar stop (9) and the oar stop sound dampener (1) as well as the flexibility of the oar stop sound dampener (1) permit the oar stop sound dampener (1) to be pushed over the oar stop (9) and positioned adjacent to the oar stop (9) on the side toward the paddle. Since the diameter of the aperture (3) is the same as, or slightly smaller than, the diameter of the shaft of the oar (8), frictional forces are sufficient to maintain the oar stop sound dampener (1) adjacent to the oar stop (9).

This placement of the oar stop sound dampener (1) between the oar stop (9) and the oar lock (7), as shown in FIG. 4 and FIG. 5, together with the resistance of the disk (2) to compression, prevents direct contact between the metal of the oar stop (9) and the oar lock (7), thus reducing noise and wear on the oar stop (9) and the oar lock (7). Noise and wear on the oar stop (9) and the oar lock (7) are further minimized by the flexible nature of the disk (2).

Removal of the oar stop sound dampener (1) for replacement or cleansing is naturally accomplished by reversing the process described above for positioning the oar stop sound dampener (1).

I claim:

1. An oar stop sound dampener, which comprises:
a disk composed of a flexible, solid, closed-cell foam and having in its center an aperture shaped to accommodate the shaft of an oar wherein the outer diameter of said disk is the same as that of the oar stop with which it is to be used and the diameter of the aperture is the same as, or slightly smaller than, that of the shaft of the oar on which the oar stop sound dampener is to be placed; and
a cover layer of plastic laminate cut to the same dimensions as, and adhesively attached to, at least one of the flat surfaces of the disk.

2. The oar stop sound dampener as recited in claim 1, wherein said flexible, solid, closed-cell foam is neoprene foam.

3. An oar stop sound dampener, which comprises:
a disk composed of a flexible, solid, closed-cell foam and having in its center an aperture shaped to accommodate the shaft of an oar wherein the outer diameter of said disk is the same as that of the oar stop with which it is to be used and the diameter of the aperture is the same as, or slightly smaller than, that of the shaft of the oar on which the oar stop sound dampener is to be placed; and
a cover layer of fabric cut to the same dimensions as, and adhesively attached to, at least one of the flat surfaces of the disk.

4. The oar stop sound dampener as recited in claim 3, wherein said flexible, solid, closed-cell foam is neoprene foam.

5. An oar stop sound dampener, which comprises:
a disk composed of a flexible, solid, closed-cell foam and having in its center an aperture shaped to accommodate the shaft of an oar wherein the outer diameter of said disk is the same as that of the oar stop with which it is to be used and the diameter of the aperture is the same as, or slightly smaller than, that of the shaft of the oar on which the oar stop sound dampener is to be placed; and
a cover layer of fabric cut to the same dimensions as, and sewn to, at least one of the flat surfaces of the disk.

6. The oar stop sound dampener as recited in claim 5, wherein said flexible, solid, closed-cell foam is neoprene foam.

7. An oar stop sound dampener, which comprises:
a disk composed of a flexible, solid, closed-cell foam and having in its center an aperture shaped to accommodate the shaft of an oar, wherein the disk is die cut along an imaginary line commencing and ending at the aperture but not extending to the outer diameter of the disk to create a segment that can be separated from the disk so that the disk can accommodate an oar stop having an elongated member extending toward the end of the oar that has the paddle.

8. The oar stop sound dampener as recited in claim 7, further comprising:
a cover layer of plastic laminate cut to the same dimensions as, and adhesively attached to, at least one of the flat surfaces of the disk and also die cut along the same line as is the disk.

9. The oar stop sound dampener as recited in claim 7, further comprising:
a cover layer of fabric cut to the same dimensions as, and adhesively attached to, at least one of the flat surfaces of the disk and also die cut along the same line as is the disk.

10. The oar stop sound dampener as recited in claim 7, further comprising:
a cover layer of fabric cut to the same dimensions as, and sewn to, at least one of the flat surfaces of the disk and also die cut along the same line as is the disk.

11. The oar stop sound dampener as recited in claim 7, wherein said flexible, solid, closed-cell foam is neoprene foam.

12. The oar stop sound dampener as recited in claim 11, further comprising:
a cover layer of plastic laminate cut to the same dimensions as, and adhesively attached to, at least one of the flat surfaces of the disk and also die cut along the same line as is the disk.

13. The oar stop sound dampener as recited in claim 11, further comprising:
a cover layer of fabric cut to the same dimensions as, and adhesively attached to, at least one of the flat surfaces of the disk and also die cut along the same line as is the disk.

14. The oar stop sound dampener as recited in claim 11, further comprising:
a cover layer of fabric cut to the same dimensions as, and sewn to, at least one of the flat surfaces of the disk and also die cut along the same line as is the disk.

15. The oar stop sound dampener as recited in claim 7, wherein:
the outer diameter of said disk is the same as that of the oar stop with which it is to be used; and
the diameter of the aperture is the same as, or slightly smaller than, that of the shaft of the oar on which the oar stop sound dampener is to be placed.

16. The oar stop sound dampener as recited in claim 15, further comprising:
a cover layer of plastic laminate cut to the same dimensions as, and adhesively attached to, at least one of the flat surfaces of the disk and also die cut along the same line as is the disk.

17. The oar stop sound dampener as recited in claim 15, further comprising:
a cover layer of fabric cut to the same dimensions as, and adhesively attached to, at least one of the flat surfaces of the disk and also die cut along the same line as is the disk.

18. The oar stop sound dampener as recited in claim 15, further comprising:

a cover layer of fabric cut to the same dimensions as, and sewn to, at least one of the flat surfaces of the disk and also die cut along the same line as is the disk.

19. The oar stop sound dampener as recited in claim 15, wherein said flexible, solid, closed-cell foam is neoprene foam.

20. The oar stop sound dampener as recited in claim 19, further comprising:

a cover layer of plastic laminate cut to the same dimensions as, and adhesively attached to, at least one of the flat surfaces of the disk and also die cut along the same line as is the disk.

21. The oar stop sound dampener as recited in claim 19, further comprising:

a cover layer of fabric cut to the same dimensions as, and adhesively attached to, at least one of the flat surfaces of the disk and also die cut along the same line as is the disk.

22. The oar stop sound dampener as recited in claim 19, further comprising:

a cover layer of fabric cut to the same dimensions as, and sewn to, at least one of the flat surfaces of the disk and also die cut along the same line as is the disk.

* * * * *